US008496231B2

(12) United States Patent
Amils et al.

(10) Patent No.: US 8,496,231 B2
(45) **Date of Patent: *Jul. 30, 2013**

(54) STEEL ROPE SAFETY SYSTEM WITH COMPACTED ROPES

(71) Applicants: Xavier Amils, Kortrijk (BE); Dale King, Van Buren, AR (US)

(72) Inventors: Xavier Amils, Kortrijk (BE); Dale King, Van Buren, AR (US)

(73) Assignee: NV Bekaert SA, Zwevegem (BE)

( * ) Notice: Subject to any disclaimer, the term of this patent is extended or adjusted under 35 U.S.C. 154(b) by 0 days.

This patent is subject to a terminal disclaimer.

(21) Appl. No.: 13/650,942

(22) Filed: Oct. 12, 2012

(65) Prior Publication Data

US 2013/0037769 A1 Feb. 14, 2013

Related U.S. Application Data

(63) Continuation of application No. 12/659,382, filed on Mar. 8, 2010, now Pat. No. 8,286,949, which is a continuation of application No. PCT/EP2008/059147, filed on Jul. 14, 2008.

(30) Foreign Application Priority Data

Sep. 6, 2007 (EP) ..... 07115809

(51) Int. Cl.
*E04H 17/14* (2006.01)

(52) U.S. Cl.
USPC ..... 256/46; 57/215

(58) Field of Classification Search
USPC ..... 256/13.1, 32, 46; 57/213, 214, 215, 57/217, 218, 219, 221, 223
See application file for complete search history.

(56) References Cited

U.S. PATENT DOCUMENTS

| | | | |
|---|---|---|---|
| 3,234,722 | A | 2/1966 | Gilmore |
| 3,404,526 | A | 10/1968 | Thomas |
| 4,270,341 | A | 6/1981 | Glushko et al. |
| 4,778,246 | A | 10/1988 | Carroll |
| 4,887,422 | A | 12/1989 | Klees et al. |
| 5,475,973 | A | 12/1995 | Furukawa et al. |
| 6,260,343 | B1 | 7/2001 | Pourladian |
| 6,962,328 | B2 | 11/2005 | Bergendahl |
| 7,036,298 | B2 | 5/2006 | Honda |
| 7,089,723 | B2 | 8/2006 | Vanneste et al. |
| 8,286,949 | B2 | 10/2012 | Amils et al. |
| 2005/0205853 | A1 | 9/2005 | Pan |

FOREIGN PATENT DOCUMENTS

| | | | |
|---|---|---|---|
| DE | 3723720 | A1 | 2/1988 |
| GB | 2406127 | A1 | 3/2005 |
| JP | 2003-293109 | | 10/2011 |
| NL | 8303820 | | 6/1985 |

OTHER PUBLICATIONS

International Search Report for PCT/EP2008/059147, dated Sep. 25, 2008 (3 pgs.).

*Primary Examiner* — Michael P Ferguson
(74) *Attorney, Agent, or Firm* — Shlesinger, Arkwright & Garvey LLP

(57) ABSTRACT

A steel rope safety system includes at least one steel rope having at least one strand, and the at least one rope or at least one strand is compacted. Further, a method is provided for making a steel rope safety system comprising the step of providing at least two wires, the step of stranding the wires thereby forming a strand for a rope and the step of compacting the strand. The steel rope safety system includes a guardrail system having vertical poles and horizontal compacted ropes which are held in place by hooks. The steel rope safety system may include non-round shaped, such as trapezoidal shaped compacted wires. There is likewise provided the use of compacted steel ropes as impact reducing material.

12 Claims, 1 Drawing Sheet

STEEL ROPE SAFETY SYSTEM WITH COMPACTED ROPES

CROSS-REFERENCE TO RELATED APPLICATIONS

This application is a continuation of application Ser. No. 12/659,382, filed Mar. 8, 2010, now U.S. Pat. No. 8,286,949, issued Oct. 16, 2012, which application Ser. No. 12/659,382 is a continuation of application no. PCT/EP2008/059147, filed Jul. 14, 2008, and which application no. PCT/EP2008/059147 claims the priority of European application no. 07115809.1, filed Sep. 6, 2007, and each of which is incorporated herein by reference.

FIELD OF THE INVENTION

The present invention relates to the field of impact reducing safety systems, in particular steel rope safety systems, and relates further to impact reducing materials in general.

BACKGROUND OF THE INVENTION

Impact reducing safety systems are used in a plurality of applications where it is important to reduce impact energy, meaning absorbing at least part of the force released upon physical impact of an object, animals or humans, on the safety system. Impact reducing safety systems are for example vehicle bumpers and vehicle deformable zones, guardrails, reinforced security doors, concrete safety barriers, safety fences, etc.

It is known in the art that, in specific impact reducing safety systems, steel rope safety systems can be used. A specific example of a steel rope safety system used in an impact reducing safety system is a safety fence in for example loading dock areas, in factories, warehouses, and other industrial areas in which moving equipment such as lorries and forklifts are used. Safety fences are important to protect personnel, equipment, and goods, to prevent accidental collision, and to decrease the impact of a moving vehicle on the personnel, equipment, or goods if accidental collision still occurs. Such safety fence is also used for burglary protection where it reduces the impact of vehicles on store windows etc.

Another specific example of a steel rope safety system used in an impact reducing safety system are energy absorbing nets and steel ropes for attenuating impact energies from rock falls, as described in US-A1-2005205853.

Another specific example of a steel rope safety system used in an impact reducing safety system are guardrails which are installed along edges or medians of roadways and highways. According to US-B2-6962328, guardrails including steel rope safety systems may reduce damage to an impacting vehicle and/or injury to occupants of the impacting vehicle as compared with other types of highway safety systems and highway barriers. Steel rope safety systems are often designed and installed with at least one steel rope mounted horizontally on a plurality of generally vertical support posts.

A recognized limitation of steel rope safety systems is the excessive deflection and elongation of the steel ropes upon impact. This is caused by closing of the outer wires of a strand around its rope and closing of the outer strands of the steel rope around its rope under tension. The closing action is the filling up of the spaces between the individual wires and the spaces between the strands. This phenomenon is called constructional stretch and has to be considered when installing the system. Nowadays, constructional stretch is decreased by pre-stretching the steel rope, usually from 30% up to 50%, before installing it in a steel rope safety system, thereby restricting further excessive deflection and elongation upon impact.

However, a disadvantage of pre-stretching the steel rope is that it may result in wire coating damage if done at relatively high temperatures and/or loads. Further, pre-stretching is an additional step in the steel rope manufacturing, which makes the manufacturing more expensive. Moreover, the constructional stretch removed during the pre-stretching operation may be re-induced as a result of final packaging and transportation effects. Another disadvantage is that pre-stretched steel rope safety systems still suffer from, although not excessive, but still severe elongation upon impact.

Given the above drawbacks of existing steel rope safety systems and methods, it is an object of the present invention to provide a steel rope safety system wherein steel rope pre-stretching can be avoided and still structural elongation upon impact can be diminished or even eliminated. In other words, a pre-stretched steel rope can be avoided; that is, a steel rope in a non-stretched condition can be provided, as will be readily appreciated by a person having ordinary skill in the art.

It is in particular an object of the present invention to provide a steel rope safety system wherein more tension is built up while keeping the same steel rope deflection upon impact compared to known steel rope safety systems.

It is further an object of the present invention to provide a steel rope safety system, wherein the same amount of tension is built up while decreasing steel rope deflection upon impact compared to known steel rope safety systems.

It is further an object of the present invention to provide a steel rope for use in impact reducing materials.

The present invention meets the above objects by using a compacted steel rope.

SUMMARY OF THE INVENTION

The present invention is directed to a steel rope safety system comprising at least one steel rope having at least one strand, characterized in that said at least one rope or at least one strand is compacted. The rope may be a mono-strand or may comprise several strands. In case of a multi-strand rope, the compacting feature relates to either the strands individually, to the rope globally or to both.

Further, the present invention is directed to a method for making a steel rope safety system comprising providing at least two wires.

stranding the wires thereby forming a strand for a rope compacting the strand.

In case of a multi-strand rope, the method further comprises the steps of:

providing at least two strands closing the strands to form a rope optionally also compacting the rope.

The present invention is also directed to the use of compacted steel ropes as impact reducing material.

DESCRIPTION OF THE INVENTION

A person skilled in the art will understood that the embodiments described below are merely illustrative in accordance with the present invention and not limiting the intended scope of the invention. Other embodiments may also be considered.

As a first embodiment, the present invention provides a steel rope safety system comprising at least one steel rope having at least one strand, characterized in that said at least one rope or at least one strand is compacted.

Figure 1:
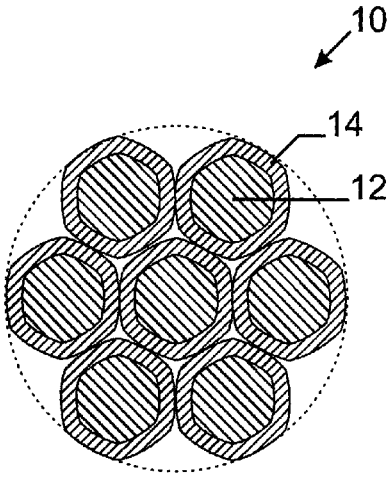
FIG. 1 illustrates a cross-section of a compacted single-strand steel rope.

In FIG. 1, a compacted steel rope 10 for use in a steel rope safety system in accordance with the present invention is illustrated. The steel rope 10 is a single-strand rope having 1+6 as construction, i.e. one core wire and 6 layer wires. Each wire has a steel core 12 and an individual zinc aluminum coating 14.

Figure 2:
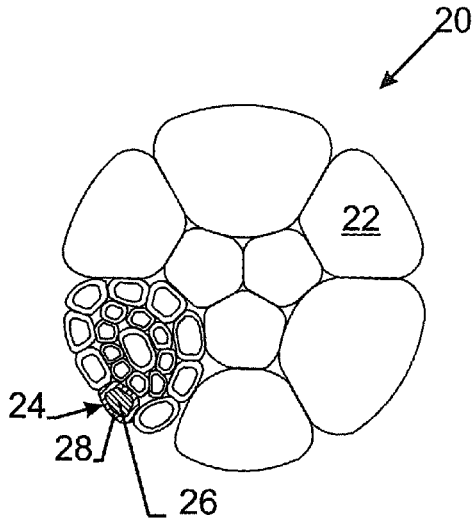
FIG. 2 illustrates a cross-section of a compacted multi-strand steel rope.

FIG. 2 illustrates a compacted steel rope 20 with a plurality of strands 22. Each strand comprises a number of steel wires 24. Each steel wire 24 has a steel core 26 and an individual corrosion resistant metal coating 28.

Due to the compacting of the at least one strand or the at least one steel rope, the gaps between the outer wires of the strands and the openings between the outer strands of the steel rope are reduced or have disappeared. As a result, the steel rope safety system when subjected to an impact has less or no structural steel rope elongation and deflection upon impact.

Figure 3:
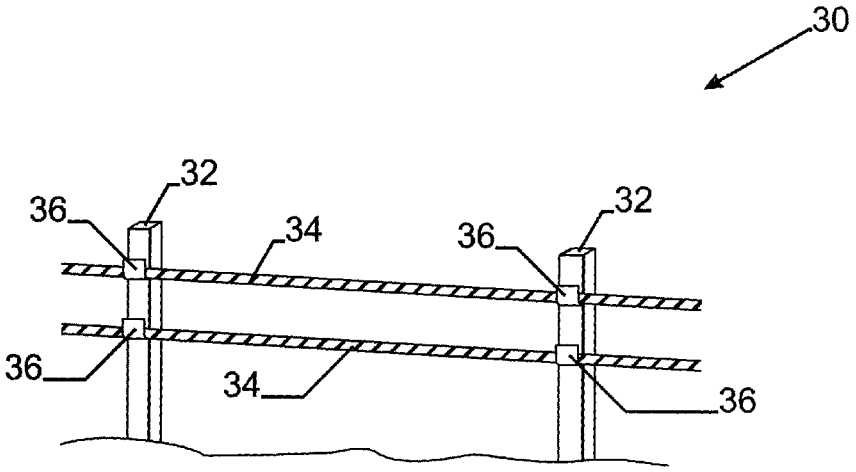
FIG. 3 illustrates a steel rope safety system.

As a matter of example, FIG. 3 illustrates a steel rope safety system 30 according to the invention. The steel rope safety system is here a guardrail system having vertical poles 32 and horizontal compacted ropes 34 which are held in place by hooks 36.

A steel rope safety system according to the invention may comprise trapezoidal shaped compacted wires.

The number of wires of the at least one compacted strand is preferably between 3 and 26, and most preferred 7 or 19. They may be helicoidally twisted and axially aligned. In the case of 7 wires the rope has a 1+6 construction, and in the case of 19 wires the rope has a 1+9+9 SZ, ZS, SS or ZZ construction.

As will be appreciated by a person having ordinary skill in the art when steel wire strands are twisted they are twisted inherently, i.e. necessarily, around a central axis. In other words, every rope inherently has a central axis, around which the filaments and/or the strands are twisted helically.

The wires of the rope may be made of high-carbon steel. A high-carbon steel has a steel composition as follows: a carbon content ranging from 0.30% to 1.15%, a manganese content ranging from 0.10% to 1.10%, a silicon content ranging from 0.10% to 1.30%, sulfur and phosphorous contents being limited to 0.15%, preferably to 0.10% or even lower; additional micro-alloying elements such as chromium (up to 0.20%-0.40%), copper (up to 0.20%) and vanadium (up to 0.30%) may be added. All percentages are percentages by weight.

In an embodiment of the steel rope safety system according to the present invention, the wires of the at least one compacted strand and/or rope may be coated. In a preferred embodiment in accordance with the invention, the wires may be coated individually to avoid corrosion in between the wires due to water leakage when using the steel rope safety system in outdoor applications such as guardrails. This coating may be any coating keeping sufficient coating properties after compacting and may preferably be zinc, zinc-aluminum or zinc-aluminum-magnesium types of alloy. A zinc-aluminum coating may be a preferred coating. This coating on the steel rope has an aluminum content ranging from 2 percent to 12 percent, e.g. ranging from 3 percent to 11 percent, with a preferable composition around the eutectoid position of about 5 percent. The zinc alloy coating further has a wetting agent such as lanthanum or cerium in an amount less than 0.1 percent of the zinc alloy. The remainder of the coating is zinc and unavoidable impurities. The zinc aluminum coating has a better overall corrosion resistance than zinc. In contrast with zinc, the zinc aluminum coating is temperature resistant and withstands optional pre-annealing. Still in contrast with zinc, there is no flaking with the zinc aluminum alloy when exposed to high temperatures. All percentages are percentages by weight.

Zinc aluminum magnesium coatings also offer an increased corrosion resistance. In a preferred zinc aluminum magnesium coating the aluminum amount ranges from 0.1 percent to 12 percent and the magnesium amount ranges from 0.1 percent to 5.0 percent. The balance of the composition is zinc and impurities. An example is an aluminum content ranging from 4 percent to 7.5 percent, and a magnesium content ranging from 0.25 to 0.75 percent. All percentages are percentages by weight.

As another embodiment, the present invention provides a method for making a steel rope safety system comprising providing at least two wires.

stranding the wires thereby forming a strand for a rope compacting the strand integrating the compacted strand in the steel rope safety system.

In case of a multi-strand rope, the method further comprises the steps of:

providing at least two strands closing the strands to form a rope optionally also compacting the rope.

Compacting of the strands or rope may be done by die drawing or by rolling. Die drawing is a technique used to produce flexible metal wire by drawing the material through a series of dies (holes) of decreasing size. Rolling is a technique where the rope wires pass along a series of compacting rolls or Turks-heads.

Preferably, the step of compacting the strands is done by means of compacting rolls, because the wires will heat up less compared to die drawing, thereby less influencing the rope's mechanical properties, e.g. impact resistance.

As will be appreciated by a person having ordinary skill in the art, and in view of the steps of compacting of the strands described herein, when compacting the multi-strand rope according to the invention such is subjected to external radial compacting forces, and which external radial compacting forces are partially transmitted into transversal forces between the contacting steel wire strands.

The step of compacting the strand may be in line with the step of stranding the wires, which means that the compacting of the strand is done immediately after stranding the wires, preferably in the same line.

The step of compacting the rope may be in line with the step of closing the strands to form a rope, which means that the compacting of the rope is done immediately after closing, preferably in the same line. In other words, the rope is compressed, as will be readily understood.

In an embodiment according to the present invention, the method of making a steel rope safety system may further comprise the step of coating the wires of the at least one steel rope.

In a preferred embodiment in accordance with the invention, coating the wires may be done before the step of stranding and compacting. A person skilled in the art would expect that, when compacting the steel wires after coating and stranding the wires, thereby deforming individually coated wires to the degree they lose their circularity, the coating would be significantly damaged, leading to diminished parameters such as loss of corrosion resistance. In accordance with the present invention however, a steel rope from individually coated and stranded wires can indeed be compacted when using a suitable coating and performing the compacting step using suitable processing parameters. When matching coating and compacting, the coating corrosion resistance is not decreased when compared to standard non compacted or non trapezoidal wire shapes.

In case the wires are coated before stranding and compacting, again compacting by rolling may be preferred, because the risk of losing wire coating and/or of damaging the wire coating is also smaller compared to die drawing. Person skilled in the art will understand that both techniques may also be mixed depending on the wire material and its compacting resistance and the type of coating used and its compacting degree. As will be readily understood by a person having ordinary skill in the art in view of the description of the compacting, closing, and coating of the wires above, and the description of the invention throughout, it will be readily understood that the such compacted and closed wires will be understood to be compressed.

The weight of the coating on the steel wires may be more than 100 g/m$^2$, and preferably more than 200 g/m$^2$; being a function of wire diameter and final application.

In a further embodiment of the invention, the method may further comprise the step of coating the strand and/or rope after compacting. After compacting, it may be useful to coat the strand or rope with preferably zinc, zinc-aluminum or zinc-aluminum-magnesium types of alloy. A person skilled in the art will understand that, incase the wires are compacted after individually coating and stranding them, this rope coating's requirements are less severe compared to the wire coating, as the wire coating does not have to withstand a compacting step.

An further advantage of compacting the steel ropes of the steel rope safety system is that the steel rope's E-modulus may be increased by more than 10%, by more than 15%, or by more than 20%. As a result, a steel rope safety system in accordance with the present invention may be provided wherein less tension is built up while keeping the same steel rope deflection upon impact compared to known steel rope safety systems. As another result, a steel rope safety system in accordance with the present invention may be provided wherein the same amount of tension is built up while decreasing steel rope deflection upon impact compared to known steel rope safety systems. The latter case may be important when using the steel rope safety system for example in a guardrail along roads with small road sections in order to avoid frontal vehicle crashes.

In a further embodiment of the invention, the at least one steel rope of the steel rope safety system may be a steel rope with a diameter decreased up to 10% when compared to the non-compacted steel rope. The air gaps that are present in the non-compacted steel rope may be filled, although intermediate diameter reductions are also possible depending on steel rope requirements. Concomitantly, this steel rope configuration may allow keeping the same impact resistance of the steel rope safety system, while reducing the steel rope diameter.

In a further embodiment of the invention, the at least one steel rope of the steel rope safety system may be a steel rope with a section increased up to 20% while maintaining its conventional diameter. The air gaps that are present in the non-compacted steel rope may be filled, although intermediate diameter reductions are also possible depending on steel rope requirements. At the same time, this configuration may allow to increase impact resistance of the steel rope safety system, while keeping the same steel rope diameter.

EXAMPLES

A person skilled in the art will understood that the examples described below are merely illustrative in accordance with the present invention and not limiting the intended scope of the invention. Other applications of the present invention may also be considered.

A steel rope safety system in accordance with the present invention may be a guardrail. Therefore, the at least one steel rope having at least one compacted strand may be horizontally positioned in guardrail posts. Such guardrails may also comprise a row of plastic or concrete blocks positioned along the road or road section and connected by at least one compacted steel rope. Upon impact of vehicles on the blocks, the compacted steel rope functions as impact reducing material.

A steel rope safety system in accordance with the present invention may be a safety fence. The safety fence may comprise for example a net of steel ropes having at least one compacted strand, which reduce impact of vehicles, animals, or humans on the safety fence and thereby function as impact reducing material.

Compacted steel strand or ropes may be implemented in safety systems like a vehicle bumper or vehicle deformable zones for acting as impact reducing material. The compacted steel ropes may be mixed with composite materials to provide both high strength and impact reducing capabilities.

In building construction, impact reducing concrete may be used for reducing impact of vehicles, airplanes, or even missiles. A steel rope safety system in accordance with the present invention may be very useful to incorporate in concrete constructions to reduce impact.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

The invention claimed is:

1. A guardrail configured for being installed along a road, comprising:

a) a plurality of guardrail posts;

b) a multi-strand steel rope being mounted and horizontally positioned on the plurality of guardrail posts;

c) the multi-strand steel rope including a plurality of steel wire strands, the steel wire strands being twisted around a central axis without a core strand being present, the steel wire strands contacting each other, and each of the steel wire strands including:

i) a steel core wire provided with a corrosion-resistant metal coating; and ii) a plurality of steel outer wires provided with a corrosion-resistant metal coating enclosing the steel core wire;

d) the multi-strand rope being subjected to external radial compacting forces, the external radial compacting forces being partially transmitted into transversal forces between the contacting steel wire strands;

e) each steel outer wire being compacted and compressed against the steel core wire and against respective adjacent steel outer wires such that the steel core wire and the plurality of steel outer wires are each compacted resulting in non-round cross-sections of the steel core wire and steel outer wires to reduce gaps between adjacent steel outer wires and to reduce gaps between the steel outer wires and the steel core wire in a non-stretched condition and to reduce elongation of the wires; and f) each steel wire strand being compacted and compressed against respective adjacent steel wire strands such that the steel wire strands are each compacted resulting in non-round cross-sections of the wire strands to reduce gaps between adjacent wire strands in a non-stretched condition and to reduce elongation of the strands.

2. A guardrail according to claim 1, wherein:

a) the non-round compacted wire strands include polygonal shaped compacted wire strands.

3. A guardrail according to claim 1, wherein:

a) the wires of the multi-strand steel rope are made of high-carbon steel.

4. A guardrail according to claim 3, wherein:

a) the wires of the multi-strand steel rope are individually coated.

5. A guardrail according to claim 4, wherein:

a) the wires are coated with one of zinc, zinc-aluminum, and zinc-aluminum-magnesium alloy.

6. A guardrail according to claim 3, wherein:

a) the weight of the coating on the wires is more than 100 $g/m^2$.

7. A guardrail according to claim 6, wherein:

a) the weight of the coating on the wires is more than 200 $g/m^2$.

8. A guardrail according to claim 3, wherein:

a) the high-carbon steel has a steel composition as follows: a carbon content ranging from 0.30 to 1.15 percent by weight, a manganese content ranging from 0.10 to 1.10 percent by weight, a silicon content ranging from 0.10 to 1.30 percent by weight, sulfur and phosphorous contents being limited to 0.15 percent by weight.

9. A guardrail according to claim 8, wherein:

a) the high-carbon steel has sulfur and phosphorous contents limited to 0.10 percent by weight.

10. A guardrail according to claim 8, wherein:

a) the high-carbon steel has additional micro-alloying elements including one of chromium up to 0.40 percent by weight, copper up to 0.20 percent by weight, and vanadium up to 0.30 percent by weight.

11. A guardrail according to claim 1, wherein:

a) the wires of the multi-strand steel rope are individually coated.

12. A guardrail according to claim 11, wherein:

a) the wires are coated with one of zinc, zinc aluminum, and zinc-aluminum-magnesium alloy.

* * * * *